US007720427B2

(12) United States Patent
Yamashita

(10) Patent No.: US 7,720,427 B2
(45) Date of Patent: May 18, 2010

(54) CLEANING APPARATUS, IMAGE HOLDING APPARATUS, AND IMAGE FORMING APPARATUS

(75) Inventor: Takayuki Yamashita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 11/898,986

(22) Filed: Sep. 18, 2007

(65) Prior Publication Data

US 2008/0240812 A1 Oct. 2, 2008

(30) Foreign Application Priority Data

Mar. 30, 2007 (JP) ..... 2007-093208

(51) Int. Cl.
*G03G 21/00* (2006.01)

(52) U.S. Cl. ..... 399/351

(58) Field of Classification Search ..... 399/71, 399/343, 350, 351; 15/256.5, 256, 51, 88, 15/88.1, 256.53
See application file for complete search history.

(56) References Cited

U.S. PATENT DOCUMENTS 4,812,878 A * 3/1989 Kaieda ..... 399/351
5,911,097 A * 6/1999 Haga et al. ..... 399/174
2006/0160011 A1* 7/2006 Inoue et al. ..... 430/109.4

FOREIGN PATENT DOCUMENTS

| | | |
|---|---|---|
| JP | 4-172486 | 6/1992 |
| JP | 2002-055582 | 2/2002 |
| JP | 2002-196642 | 7/2002 |
| JP | 2002-244521 | 8/2002 |
| JP | 2004-117438 | 4/2004 |
| JP | 2004-184462 | 7/2004 |
| JP | 2004-286827 | 10/2004 |
| JP | 2005-227672 | 8/2005 |

* cited by examiner

*Primary Examiner*—David M Gray
*Assistant Examiner*—Gregory H Curran
(74) *Attorney, Agent, or Firm*—Morgan, Lewis & Bockius LLP

(57) ABSTRACT

There is provided a cleaning apparatus having a cleaning member that makes contact with a surface of an image holder and vibrates due to friction arising when the surface of the image holder moves, the image holder bearing an electrostatic latent image developed using a developer having toner containing a crystalline resin, and a cleaning member support unit that supports the cleaning member and increases the amplitude of the vibration of the cleaning member.

10 Claims, 6 Drawing Sheets

| NUMBER OF PRINTED SHEETS (IN SHEETS) / PHOTORECEPTOR CLEANER | 5000 | 10000 | 14000 | 18000 |
|---|---|---|---|---|
| PHOTORECEPTOR CLEANER 60A | △ | × | × | × |
| PHOTORECEPTOR CLEANER 60 | ○ | ○ | ○ | ○ |

FIG. 2A
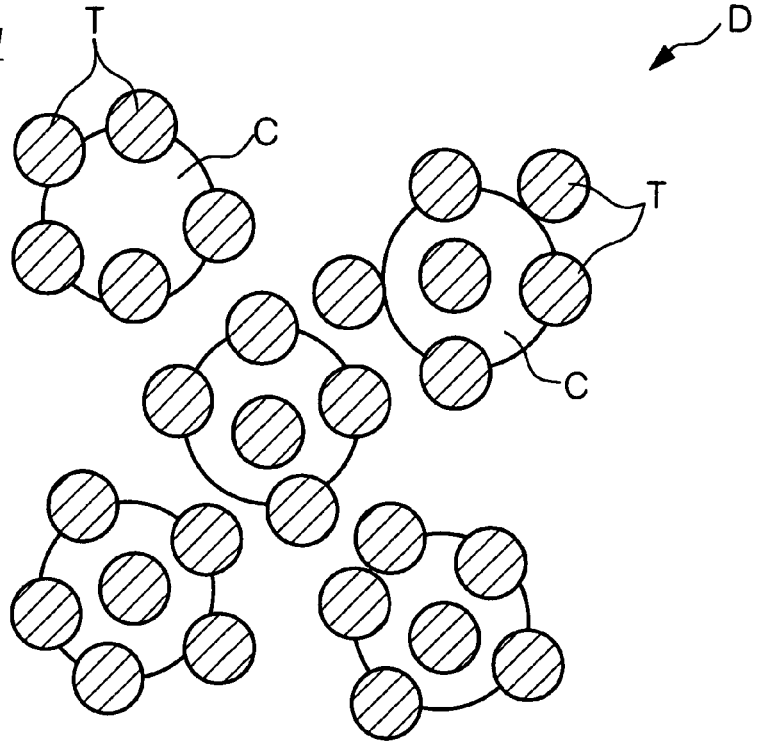
FIG. 2B
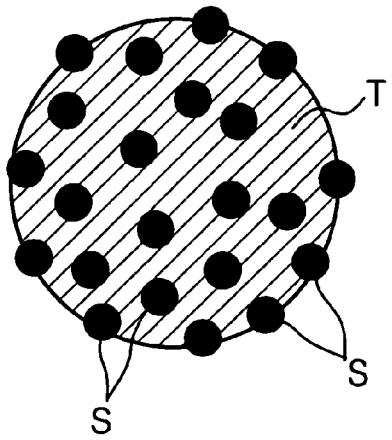
FIG. 12
| NUMBER OF PRINTED SHEETS (IN SHEETS) / SHAPE FACTOR SF | 5000 | 10000 | 14000 | 18000 |
|---|---|---|---|---|
| 110 | × | × | × | × |
| 122 | ○ | ○ | ○ | ○ |
| 135 | ○ | ○ | ○ | ○ |

| NUMBER OF PRINTED SHEETS (IN SHEETS) / IMAGE FORMING APPARATUS | 5000 | 10000 | 14000 | 18000 |
|---|---|---|---|---|
| CONVENTIONAL IMAGE FORMING APPARATUS | ○ | ○ | △ | × |
| IMAGE FORMING APPARATUS 1 | ○ | ○ | ○ | ○ |

*FIG. 9*
| THICKNESS W OF PLATE SPRING [mm] \ NUMBER OF PRINTED SHEETS (IN SHEETS) | 5000 | 10000 | 14000 | 18000 |
|---|---|---|---|---|
| 0.20 | × | × | × | × |
| 0.10 | ○ | ○ | ○ | ○ |
| 0.08 | ○ | ○ | ○ | ○ |
*FIG. 10*
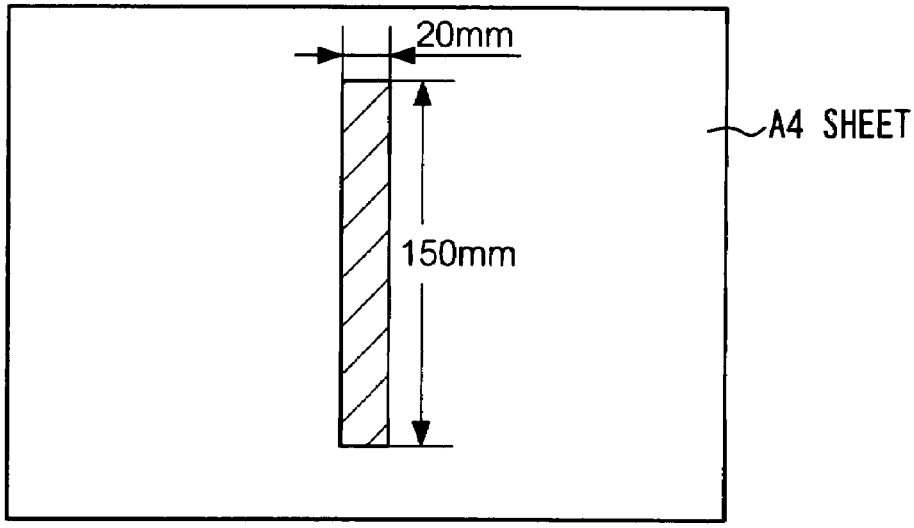
*FIG. 11*
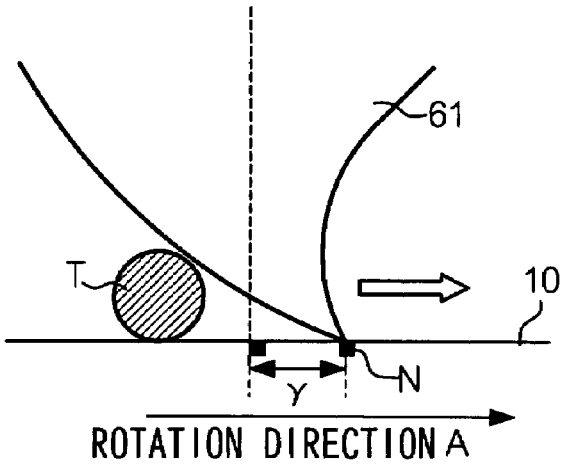

CLEANING APPARATUS, IMAGE HOLDING APPARATUS, AND IMAGE FORMING APPARATUS

CROSS-REFERENCE TO RELATED APPLICATION(S)

This application is based on and claims priority under 35 USC 119 from Japanese Patent Application No. 2007-093208 filed Mar. 30, 2007.

BACKGROUND

1. Technical Field

The present invention relates to a cleaning apparatus, an image holding apparatus, and an image forming apparatus.

2. Related Art

Electrophotographic image forming apparatuses form an image on an image holder such as a photoreceptor and transfer the formed image to a recording medium. Residue of the toner transferred to the recording medium at this time remains on the surface of the image holder. Therefore, the residual toner is removed by rotating the image holder in a state in which a cleaning member composed of a material such as rubber is pressed against the surface of the image holder.

SUMMARY

According to one aspect of the invention, a cleaning apparatus includes a cleaning member that makes contact with a surface of an image holder and vibrates due to friction arising when the surface of the image holder moves, the image holder bearing an electrostatic latent image developed using a developer having toner containing a crystalline resin, and a cleaning member support unit that supports the cleaning member and increases the amplitude of the vibration of the cleaning member.

BRIEF DESCRIPTION OF THE DRAWINGS

Exemplary embodiment(s) of the present invention shall be described in detail based on the following figures, wherein:

FIGS. 2A and 2B are diagrams illustrating developer D;

FIG. 9 is a diagram illustrating the relationship between the thickness of a plate spring and the degree of occurrence of white patches;

FIG. 10 is a diagram schematically illustrating an image used in an experiment;

FIG. 11 is an enlarged view of the area where toner comes into contact with a photoreceptor and a cleaning blade;

FIG. 12 is a diagram illustrating the relationship between the shape factor of toner and the degree of occurrence of white patches.

DETAILED DESCRIPTION

Hereinafter, an exemplary embodiment of the present invention shall be described in detail with reference to the drawings.

(1) Configuration of the Exemplary Embodiment

First, a configuration of the exemplary embodiment of the present invention shall be described.

Figures 1, 7:
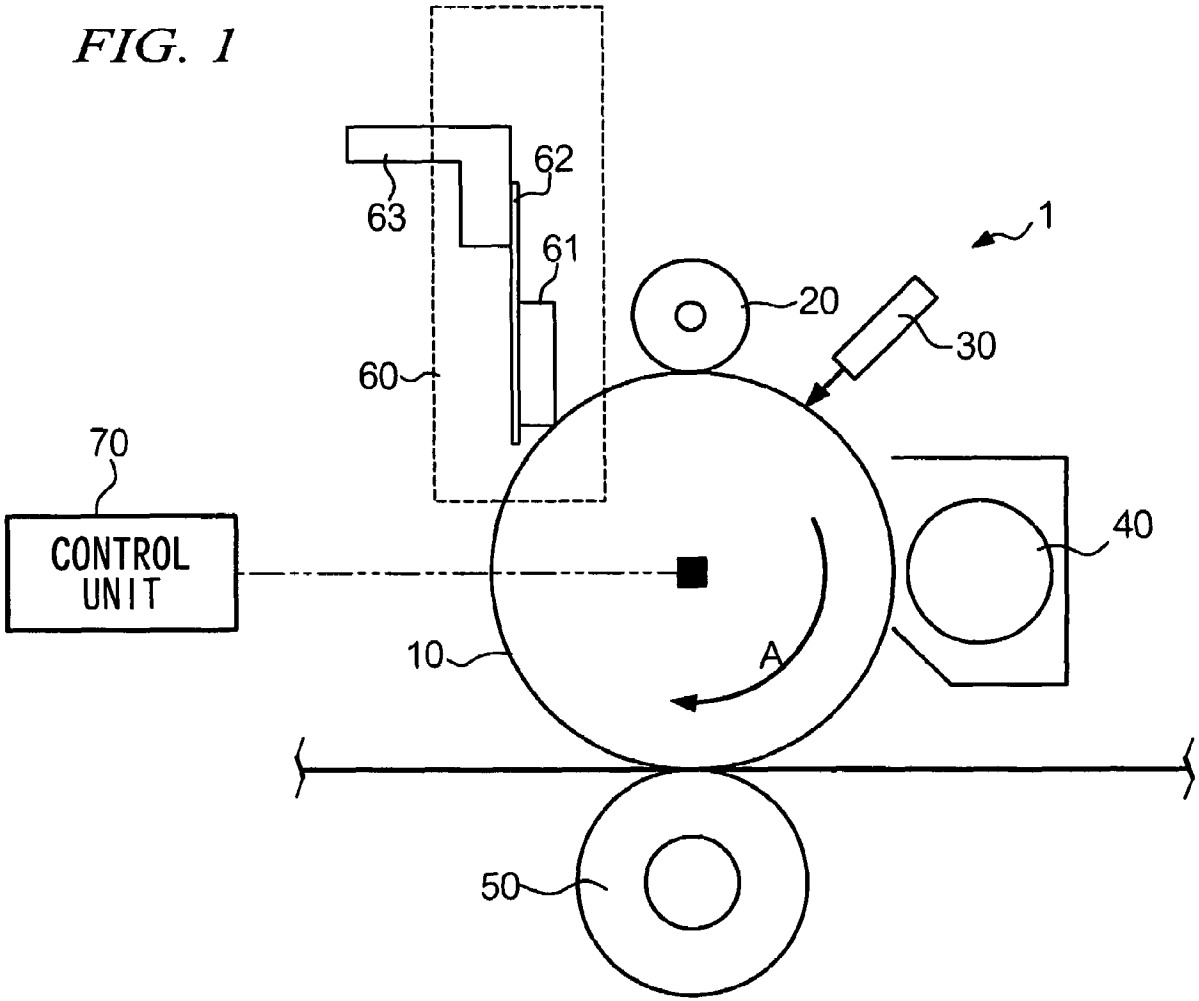
FIG. 1 is a diagram showing a general configuration of an image forming apparatus.
FIG. 7 is a diagram illustrating the relationship between the presence/absence of a vibration damper and the degree of occurrence of white patches.

FIG. 1 is a diagram showing a configuration of relevant elements that carry out image formation in an image forming apparatus 1 according to the present exemplary embodiment. A charging roll 20, an exposure unit 30, a developing unit 40, a transfer roller 50, and a photoreceptor cleaner 60 are disposed around a photoreceptor 10 included in the image forming apparatus 1. Furthermore, the image forming apparatus 1 includes a control unit 70 that controls these elements.

The photoreceptor 10 is an image holder in which a photoreceptive layer is formed on the surface of a cylindrical drum, and is rotated around the central axis thereof by a driving unit (not shown) in the direction of the arrow A indicated in the diagram (in the clockwise direction). The charging roll 20 is a charging member, the surface of which makes contact with the surface of the photoreceptor 10. The charging roll 20 rotates in accordance with the rotation of the photoreceptor 10, and charges the surface of the photoreceptor 10 with a predetermined electric potential. The exposure unit 30 irradiates (exposes) the surface of the charged photoreceptor 10 with a laser or an LED, thereby forming an electrostatic latent image on the surface of the photoreceptor 10.

When the electrostatic latent image formed on the surface of the photoreceptor 10 reaches a position opposite of the developing unit 40 due to the rotation of the photoreceptor 10, the developing unit 40 develops the electrostatic latent image by supplying developer D to the electrostatic latent image, and forms a toner image on the surface of the photoreceptor 10.

FIG. 2A is an enlarged view of the developer D. In FIG. 2A, toner T and carrier C make up the primary elements of the developer D. The carrier C is a magnetic material larger than the toner T. The toner T contains crystalline resin. By containing crystalline resin, the toner T has characteristics such as a low melting point, softness, and so on. In other words, the energy necessary for fixing is less in the case where a fixing device (not shown) fixes a toner image formed using the developer D shown in FIG. 2A than in the case where a fixing device fixes a toner image using a developer aside from the developer D shown in FIG. 2A.

FIG. 2B is an enlarged view of the toner T. In FIG. 2B, plural external additive particles S are added to the spherical surface of the toner T. The external additive particles S are fine particles having a particle size of 1 μm or less, and are added to the toner T for the purpose of improving the liquidity, stabilizing the charge property, and improving the cleanability thereof. Silica, titanium, or the like are used in the external additive particles S.

In FIG. 1, when the toner image formed on the surface of the photoreceptor 10 reaches a position making contact with the transfer roller 50 due to the rotation of the photoreceptor 10, the transfer roller 50 transfers the toner image to a recording medium such as paper due to electrostatic force or the like. The paper onto which the toner image has been transferred is transported to a fixing device (not shown), and after the toner image has been fixed, the paper is ejected to the exterior of the apparatus.

The control unit 70 controls the rotation speed of the photoreceptor 10 by selectively switching the rotation speed of the photoreceptor 10.

Figures 3, 13:
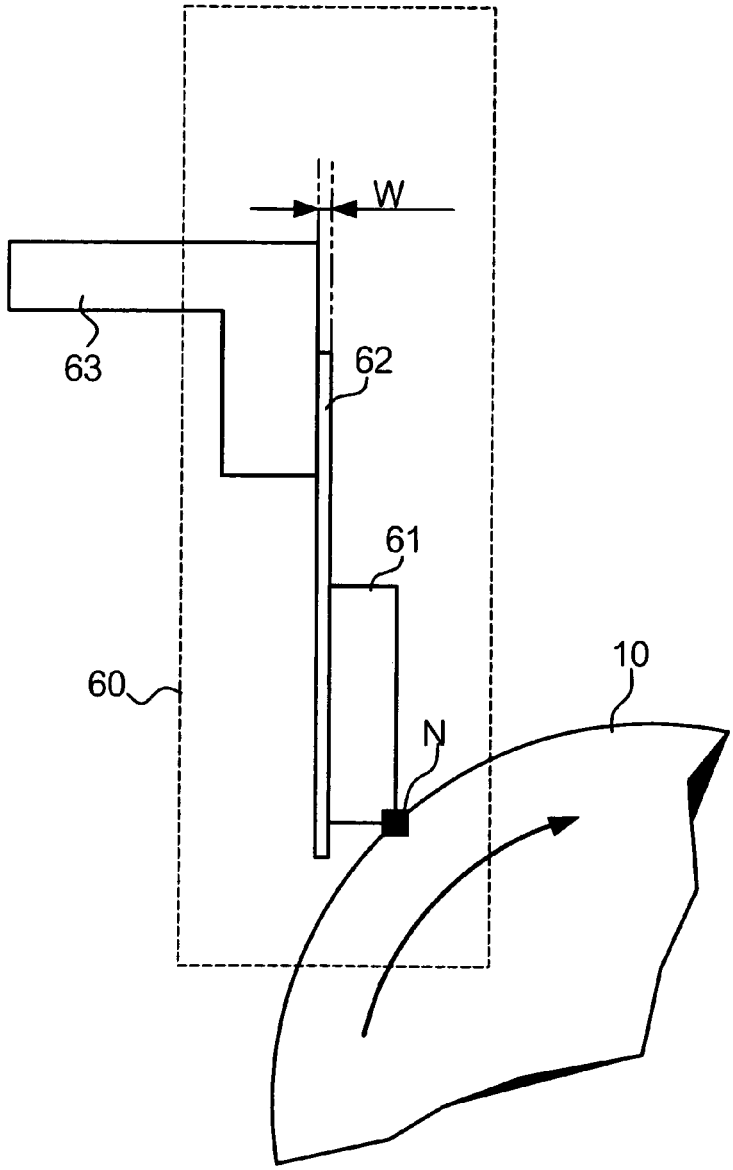
FIG. 3 is a diagram showing an enlarged view of the configuration of a photoreceptor cleaner.
FIG. 13 is a diagram comparing the degree of occurrence of white patches in an image forming apparatus according to an exemplary embodiment and a conventional image forming apparatus.

FIG. 3 is a diagram showing an enlarged view of the configuration of the photoreceptor cleaner 60 of FIG. 1.

The photoreceptor cleaner 60 includes a cleaning blade 61 as a cleaning member, and a plate spring 62 as a support member. The cleaning blade 61 is a tabular member or a substantially tabular member having roughly the same width as the photoreceptor 10 along the axial direction. The plate spring 62 is a tabular member or a substantially tabular member having a width (in the lengthwise direction) greater than that of the cleaning blade 61. One surface of the plate spring 62 is anchored to a metallic member 63 by an adhesive or a predetermined fastening device, the metallic member 63 being attached to the housing of the image forming apparatus 1. The cleaning blade 61 is anchored to the other surface of the plate spring 62 by an adhesive. As shown in FIG. 3, the plate spring 62 supports the cleaning blade 61; through this, one corner of the cleaning blade 61 is pushed against the surface of the photoreceptor 10 with a predetermined pressure at a contact part N. The photoreceptor 10 rotates in the direction indicated by the arrow A, and through this, the cleaning blade 61 scrapes off developer remaining on the surface of the photoreceptor 10. The cleaning blade 61 is formed from a viscoelastic material such as 1-3 mm-thick polyurethane rubber or a resin such as 50-500 μm-thick polyethylene terephthalate (PET), polyimide (PI), polycarbonate (PC), and so on. The material, dimensions, and so on of the plate spring 62 are designed so that a loss coefficient expressing the size of the loss modulus relative to the size of the elastic modulus is smaller than that of the cleaning blade 61. The loss coefficient shall be discussed in detail later. In the present exemplary embodiment, steel use stainless (SUS) of a thickness W of 0.08 mm is used for the plate spring 62.

(1-1) Relationship Between Rotation of Photoreceptor 10 and Skew of Cleaning Blade 61

Next, the relationship between the rotation of the photoreceptor 10 and the skew of the cleaning blade 61 shall be described.

Figure 4A:
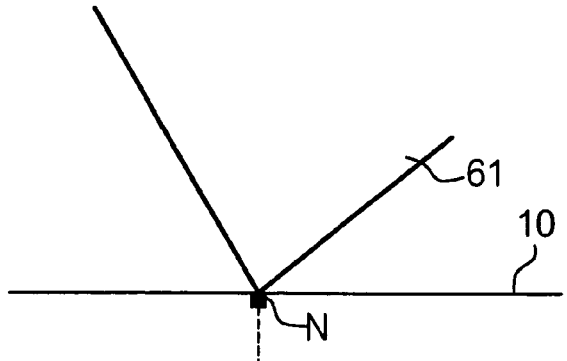
FIGS. 4A and 4B are enlarged views of the area where a photoreceptor and a cleaning blade come into contact with one another.
Figure 4B:
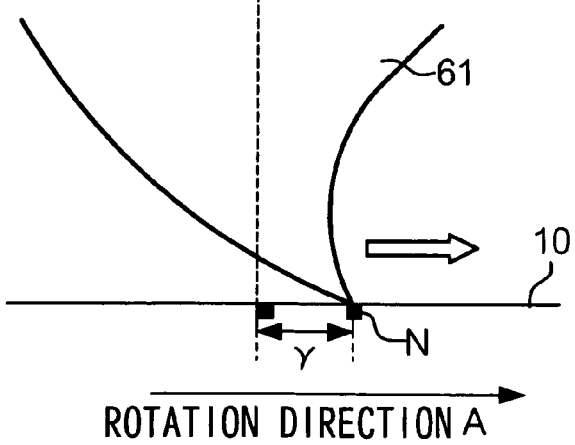

FIGS. 4A and 4B are enlarged views of the area where the photoreceptor 10 and the cleaning blade 61 come into contact with one another. As shown in FIG. 4A, when the photoreceptor 10 is not rotating, one corner of the cleaning blade 61 is in contact with the surface of the photoreceptor 10 at the contact part N.

Next, the state of the cleaning blade 61 when the photoreceptor 10 is rotating shall be described. When the photoreceptor 10 is rotating in the direction of the arrow A shown in FIG. 4B, the cleaning blade 61 is pulled in the tangential direction of the surface of the photoreceptor 10, as shown in FIG. 4B. This is caused by friction arising between the photoreceptor 10 and the cleaning blade 61; through this friction, stress is exerted on the cleaning blade 61 in the direction indicated by the white arrow. The degree of skew is indicated by a distance "□" from the position of the contact part N when the photoreceptor 10 is stopped to the position of the contact part N when the photoreceptor 10 is rotating. As the photoreceptor 10 continues to rotate, γ gradually increases; however, as the force by which the cleaning blade 61 tries to return to its original form, which is caused by elasticity, increases, the cleaning blade 61 tries to return to its original form, and γ decreases thereby. If the stated stress caused by friction becomes greater than the force by which the cleaning blade 61 tries to return, the cleaning blade 61 once again is skewed in the direction indicated by the white arrow, and γ once again increases. In this manner, the contact part N of the cleaning blade 61 vibrates through side-to-side reciprocating movement. This series of movements shall be called "self-excited vibration" hereinafter. If the rotational speed is constant, this movement is repeated, and thus it can be said that the cleaning blade 61 undergoes self-excited vibration at a constant vibration amplitude. The size of the vibration amplitude of the cleaning blade 61 depends on the rotational speed of the photoreceptor 10. Specifically, the vibration amplitude is greater, and the cleaning blade 61 is skewed more, the slower the rotational speed is.

The relationship between the rotational speed of the photoreceptor 10 and the vibration amplitude of the cleaning blade 61 shall be described here.

The degree of skew of the cleaning blade 61 is determined based upon the degree of stress acting upon the cleaning blade 61. Stress is made up of elastic stress and viscous stress; elastic stress is a component with the same phase as the skew, whereas viscous stress is a component having a phase delayed by π/2 of the elastic stress. The elastic stress is uniquely determined in accordance with the degree of the skew of the cleaning blade 61. On the other hand, the degree of viscous stress grows proportionally to the speed of skew. In other words, if the case where the rotational speed of the photoreceptor 10 is high is compared to the case where the rotational speed of the photoreceptor 10 is low, while the elastic stress of both is the same in both cases, the viscous stress is greater in the former case.

Because the phase of the viscous stress is delayed by π/2 of the elastic stress, the viscous stress causes the phase of the stress acting upon the cleaning blade 61 to be delayed by exactly π/2, which gives rise to a damping effect. In other words, the greater the viscous stress, the more difficult it is for the cleaning blade 61 to be skewed.

Accordingly, the lower the rotational speed of the photoreceptor 10, the lower the viscous stress is relative to the stress; thus, the greater the skew of the cleaning blade 61 becomes, and the greater the vibration amplitude of the self-excited vibration becomes. Conversely, the higher the rotational speed of the photoreceptor 10, the higher the viscous stress is relative to the stress; thus, the skew of the cleaning blade 61 is dampened. However, because the elastic stress is constant regardless of the rotational speed of the photoreceptor 10, the skew of the cleaning blade 61 decreases, and the vibration amplitude of the self-excited vibration decreases.

Figure 5:
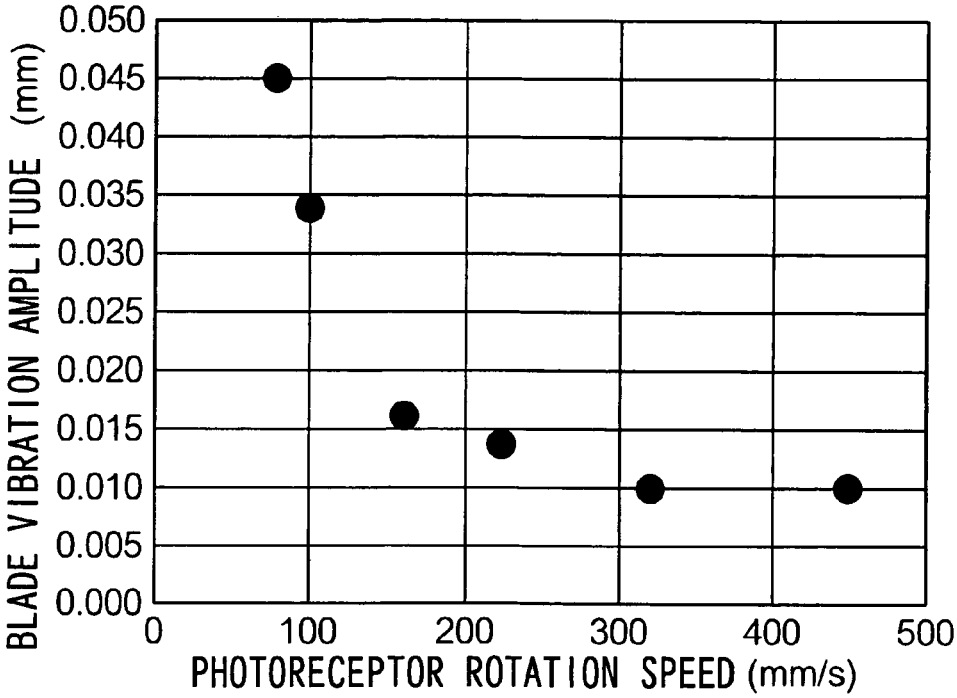
FIG. 5 is a graph illustrating the relationship between the rotational speed of a photoreceptor and the vibration amplitude of a cleaning blade.

FIG. 5 is a graph showing the relationship between the rotational speed of the photoreceptor 10 and the vibration amplitude of the self-excited vibration of the cleaning blade 61. As shown in FIG. 5, the lower the rotational speed of the photoreceptor 10, the greater the vibration amplitude of the cleaning blade 61 becomes, and the vibration amplitude decreases as the rotational speed increases. The rotational speed of the photoreceptor 10 when the image forming apparatus 1 forms an image through charging, latent image forming, developing, and transferal is roughly 150-350 mm/s; thus, it is desirable for the rotational speed during cleaning of the photoreceptor 10 to be 100 mm/s or less. The reason for this is that the vibration amplitude of the cleaning blade 61 is greater the lower the rotational speed of the photoreceptor 10, and thus the toner can be more effectively diffused from the surface of the photoreceptor 10. As can be seen in FIG. 5, when the rotational speed is 100 mm/s or less, the vibration amplitude of the cleaning blade 61 becomes extremely large (a vibration amplitude of approximately 0.035 mm or more). This degree of vibration amplitude is suitable for cleaning the photoreceptor 10. This is because the toner cannot be completely diffused, toner adheres to the cleaning blade 61, and the toner cannot be completely removed from the photoreceptor 10 if the vibration amplitude is low when cleaning the surface of the photoreceptor 10.

As described thus far, when cleaning the surface of the photoreceptor 10 using the photoreceptor cleaner 60, the control unit 70 controls the rotational speed of the photoreceptor 10 to become lower compared to when forming an image. The control unit 70 rotates the photoreceptor 10 for several rotations at low speed and causes the photoreceptor cleaner 60 to clean the surface thereof at, for example, a timing specified by the user when the image forming process is not underway, or when printing has reached a predetermined number of sheets, when the power of the image forming apparatus 1 is turned on, or the like.

(1-2) Effect of Plate Spring 62

As described earlier, in the present exemplary embodiment, the thickness of the plate spring 62 is less than the thickness of the cleaning blade 61, and the loss coefficient expressed by the percentage of the loss modulus relative to the elastic modulus in the plate spring 62 is set so as to be lower than the loss coefficient of the cleaning blade 61. The reason for supporting the cleaning blade 61 by the plate spring 62 that has such properties shall be explained hereinafter.

It is common to use viscoelastic materials such as rubbers or resins as the material of the cleaning blade 61, and the properties of these materials are strong as viscous bodies. However, metals such as the above-mentioned SUS, ceramic materials, and so on are used in the plate spring 62, and thus the plate spring 62 has properties that are weak as viscous bodies and strong as elastic bodies. In other words, a cleaning blade 61 formed of materials with strong viscosity properties suffer from significant vibration dampening, and thus it is difficult to maintain vibrations that sufficiently remove toner that has adhered to the cleaning blade 61 and that prevent toner from adhering to the cleaning blade 61. Accordingly, the vibrations arising in the cleaning blade 61 can be maintained by supporting the cleaning blade 61 by a plate spring 62, which has weak properties as a viscous body.

Figure 6:
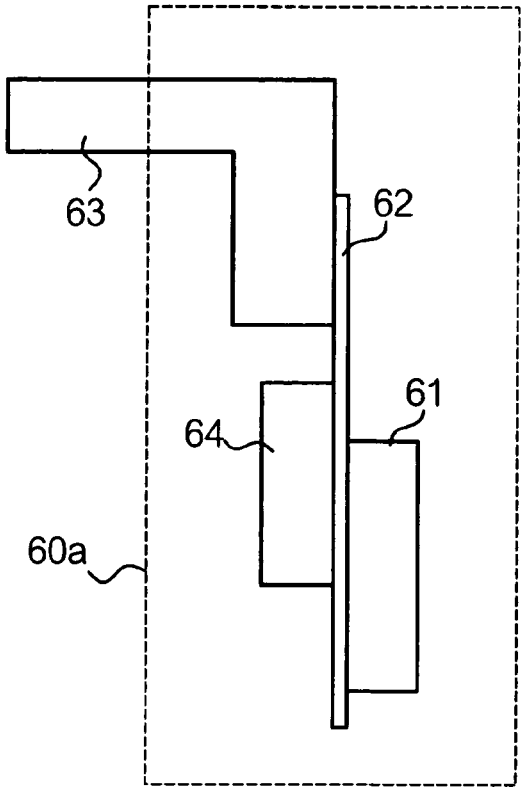
FIG. 6 is a diagram showing an enlarged view of the configuration of a photoreceptor cleaner having a vibration damper.

Here, the relationship between the vibration amplitude of the cleaning blade 61 and the cleaning performance of the surface of the photoreceptor 10 shall be explained. FIG. 6 is a diagram showing the configuration of a photoreceptor cleaner 60*a* in which a vibration damper 64 has been affixed to the surface of the plate spring 62 opposite the surface that supports the cleaning blade 61. The vibration damper 64 has a thickness of 1 mm and a loss coefficient of 0.8, which is greater than the loss coefficient 0.1 of the cleaning blade 61 and the loss coefficient of the plate spring 62. Therefore, by providing the vibration damper 64, the vibration amplitude of the cleaning blade 61 of the photoreceptor cleaner 60*a* is less than that of the photoreceptor cleaner 60. FIG. 7 is a diagram illustrating the results of an experiment to see to what degree white patches occur depending on the number of pages printed, in the case of using the photoreceptor cleaner 60 in an image forming apparatus, and in the case of using the photoreceptor cleaner 60*a* in an image forming apparatus. In FIG. 7, white patches not occurring is indicated by a circle; white patches occurring is indicated by an x; and temporary occurrence of white patches that soon disappear is indicated by a triangle.

As shown in FIG. 7, the temporary occurrence of white patches was confirmed in the image forming apparatus that uses the photoreceptor cleaner 60*a* when the number of printed pages reached 5,000. This indicates that toner is adhering to the cleaning blade 61 when the number of printed pages is approximately 5,000 in the case of using the photoreceptor cleaner 60*a*. However, in the image forming apparatus 1 using the photoreceptor cleaner 60 according to the stated exemplary embodiment, white patches did not occur when the number of printed pages was approximately 5,000. When the number of printed pages reached 10,000, the intermittent occurrence of white patches was confirmed in the image forming apparatus using the photoreceptor cleaner 60*a*, and thus it can be seen that toner had become fixed on the cleaning blade 61 and the cleaning performance had decreased. However, in the image forming apparatus 1 using the photoreceptor cleaner 60, white patches were still unconfirmed, and thus it can be seen that toner was not becoming fixed on the cleaning blade 61, which is a cause of a decrease in cleaning performance. Based on these experimental results, it was confirmed that increasing the vibration amplitude of the cleaning blade 61 makes it difficult for toner to build up on the cleaning blade 61. As a result, it is possible to reduce fixing of the toner to the cleaning blade 61.

In the present exemplary embodiment, the surface of the photoreceptor 10 is cleaned by the cleaning blade 61 undergoing self-excited vibration in accordance with the stress arising through rotation of the photoreceptor 10. Therefore, it is necessary to set the material, shape, and so on of the plate spring 62 so that the vibration amplitude is high. In other words, it is desirable for the loss coefficient of the plate spring 62 to be low.

Figure 8:
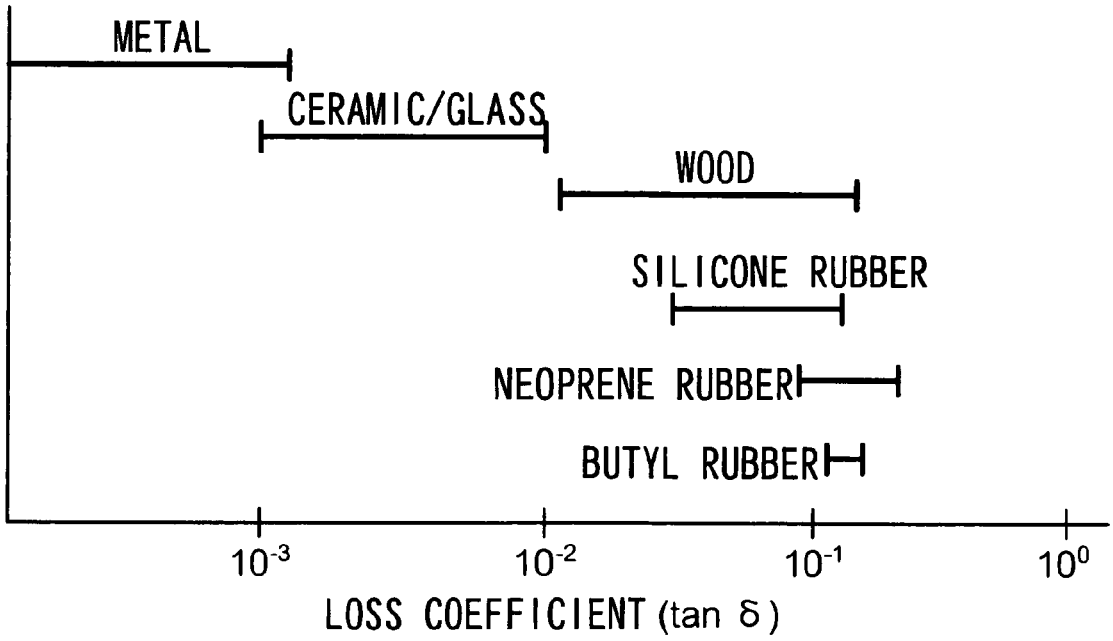
FIG. 8 is a diagram comparing loss coefficients of various materials.

FIG. 8 is a graph showing experimental results that indicate the relationship between various materials and loss coefficients. Note that in FIG. 8, the loss coefficient of metal, ceramic, glass, wood, silicone rubber, neoprene rubber, and butyl rubber are shown. Note that the loss coefficient of each material is a value measured in a 25° C. environment.

First, a method for measuring the loss coefficients of the stated materials shall be explained. First, one end of a material sample of a cross-sectional area S and a length L is anchored, and static tension is applied from the other side so that the sample does not sag. In this state, sine wave oscillation is applied. Then, a signal indicating the relationship of stress and elastic stress (skew) (in other words, a stress waveform and a skew waveform) is outputted. It should be noted that a stretching jig is used in this case. In the case where a compression jig is used, a static load is added, and in the case where a shearing jig, a bending jig, or the like is used, static tension, load and the like is not applied. Here, a method for calculating a complex elastic modulus E* is shown, in the case where stress and skew are assumed to be complex numbers. In addition, below, DF is dynamic stress (0-peak value of the stress waveform); DD is dynamic skew (0-peak value of the skew waveform); $\delta$ is the phase difference between the stress waveform and the skew waveform; E' is the elastic modulus; E" is the loss modulus; $\epsilon$ is the base of a natural logarithm; and $\omega$ is the number of sine wave oscillations.

$$E^* = \text{stress[Pa]/skew rate[\%]}$$
$$= [DF/S * \epsilon\{i(\omega * t + \delta)\}]/\{DD/L * \epsilon(i * \omega * t)\}$$
$$= [DF/S * \epsilon\{\cos(\omega * t + \delta) + i * \sin(\omega * t + \delta)\}]/[DD/L * \epsilon\{\cos(\omega * t) + i * \sin(\omega * t)\}]$$
$$= (DF * L\{\cos(\omega * t) + i * \sin(\omega * t)\}/(DD * S))$$
$$|E^*| = (DF * L)/(DD * S)$$
$$E^* = E' + iE''$$
$$E' = |E^*|\cos\delta \quad E'' = |E^*|\sin\delta$$
$$\tan\delta = E''/E'$$

The loss coefficient tan δ calculated in this manner indicates the percentage of the loss modulus E" relative to the elastic modulus E'. As shown in FIG. 8, the loss coefficient tan δ of metal and ceramic/glass is a value no greater than about $10^{-2}$. However, the loss coefficient tan δ of rubber materials used in the cleaning blade 61 (the silicone rubber, neoprene rubber, and butyl rubber shown in the diagram) is a value greater than about $10^{-2}$. Therefore, in the present exemplary embodiment, the material, measurements, and the like of the plate spring 62 may be determined under the condition that the loss coefficient tan δ is no more than about $10^{-2}$. The inventors confirmed that according to this condition, the vibration amplitude of the cleaning blade 61 does not decrease, and self-excited vibration can be carried out. If the loss coefficient of the plate spring 62 being less than the loss coefficient of the cleaning blade 61 is specified as a condition, it is possible to increase the elastic stress of the cleaning blade 61, as compared to a configuration that does not use the plate spring 62.

Here, descriptions shall be given regarding the thickness W of the plate spring 62 and the presence/absence of white patches occurring every predetermined number of printed sheets at the time of image formation.

FIG. 9 is a diagram illustrating the thickness W of the plate spring 62 and the state of the occurrence of white patches per number of printed sheets, obtained based on the results of experimentation by the inventors. In FIG. 9, white patches not occurring is indicated by a circle, whereas white patches occurring is indicated by an x.

The conditions of the cleaning blade 61 and the plate spring 62 in this experiment are as follows. In a still state, the cleaning blade 61 has a thickness (length when taken in the thickness direction of the plate spring 62) of 1.2 mm, a length along the axial direction of the photoreceptor 10 of 330 mm, a side length (length of the direction perpendicular to the thickness direction and the axial direction of the photoreceptor drum 10) of 5 mm, and a hardness degree of 80. In a still state, the plate spring 62 has a length along the axial direction of the photoreceptor 10 of 330 mm, and a width of 10 mm; the material of the plate spring 62 is SUS. At this time, a predetermined number of sheets were created, in which an image 20 mm wide, 150 mm long, and having an image density of 100% (a so-called solid color) is created on an A4 sheet, as indicated by the hatched area in FIG. 10. After this, an image having an image density of 30% was created on the entirety of the sheet, and the presence/absence of white patches was determined.

As shown in FIG. 9, it was confirmed that white patches did not occur in the formed image even when the number of printed sheets reached 18,000, and that the surface of the photoreceptor 10 was being cleaned with a favorable cleaning performance, in the case where a plate spring 62 having a thickness W of 0.08 mm or 0.10 mm was used. However, it was also confirmed that white patches did occur in the image when the number of printed sheets was 5,000, and that toner was adhering to the cleaning blade 61 to an extent where the cleaning performance decreased, in the case where a plate spring 62 having a thickness W of 0.20 mm was used. The reason for this is that the greater the thickness W of the plate spring 62, the greater the loss coefficient becomes; hence the cleaning blade 61 does not undergo self-excited vibration, or the vibration amplitude of the self-excited vibration is small, and thus the toner is not completely removed from the surface of the photoreceptor 10. In other words, these experimental results confirmed that if the thickness W of the plate spring 62 is 0.10 mm or less, toner adhering to the cleaning blade 61, which is a cause of a decrease in cleaning performance, can be expected to decrease. If the thickness W of the plate spring 62 is increased, the spring constant of the plate spring 62 increases as well, and thus the change in shape of the plate spring 62 becomes small even if friction arises between the cleaning blade 61 and the photoreceptor 10. In other words, it becomes difficult for the cleaning blade 61 to vibrate.

Note that when the plate spring 62 has a thickness W of 0.10 mm, the spring constant per 1 mm width is about 5 grams per millimeter. In other words, if the spring constant of the plate spring 62 is less than or equal to about 5 grams per millimeter, the vibration amplitude of the cleaning blade 61 is increased, and this amplitude can be maintained, thus making it possible to reduce the adherence of toner.

(1-3) Relationship Between Shape of Toner and Adherence to Cleaning Blade 61

In the case of using toner containing the aforementioned crystalline resin, the toner is comparatively soft; depending on the form thereof, the toner can easily adhere to the cleaning blade 61, thus decreasing the cleaning performance. Here, the relationship between the shape of the toner and the ease with which the toner adheres to the cleaning blade 61 shall be explained. FIG. 11 is an enlarged schematic view showing the toner T on the surface of the photoreceptor 10, the photoreceptor 10 itself, and the cleaning blade 61.

As shown in FIG. 11, the closer the form of the toner T that has collected on the photoreceptor 10 is to being spherical, the lower the rolling resistance of the toner T is, and the easier it rotates. For this reason, there are situations where the toner T rolls in the direction of the contact part N between the cleaning blade 61 and the photoreceptor 10 (in the diagram, from left to right), in accordance with the rotation of the photoreceptor 10. Because the cleaning blade 61 is pressed upon the surface of the photoreceptor 10 with a predetermined pressure, when the toner T reaches the vicinity of the contact part N and the height of the toner T becomes less than the width of the cleaning blade 61 and the photoreceptor 10, the toner T may be crushed. The toner T crushed in this manner adheres to the cleaning blade 61.

Note that the shape of the toner (how spherical the toner is) is expressed below as a shape factor; the shape factor SF of the toner takes a representative value from calculations of the ratio between the projected area of the toner and the area of a circumscribed circle thereof for plural toner particles. The calculation equation is expressed by equation (1) shown below.

(Equation 1)

$$\text{shape factor } SF = ((\text{absolute maximum length of toner diameter})^2 / (\text{projected area of toner}) \times (\pi/4) \times 100 \quad (1)$$

Here, descriptions shall be given regarding the shape of the toner and the presence/absence of white patches occurring every predetermined number of printed sheets at the time of image formation. FIG. 12 is a diagram illustrating the shape factor SF of the toner and the state of the occurrence of white patches per number of printed sheets, obtained based on the results of experimentation by the inventors. In FIG. 12, white patches not occurring is indicated by a circle, whereas white patches occurring is indicated by an x.

As shown in FIG. 12, it was confirmed that white patches did not occur in the formed image even when the number of printed sheets reached 18,000, and that adherence of toner to the cleaning blade 61 had decreased, in the case where the shape factor SF was 122 or 135. This is because the toner takes on a more axiolitic shape the greater the value of the shape factor SF is; the rolling resistance of the toner thus increases, and it becomes more difficult for the toner to roll. However, it was also confirmed that white patches did occur in the image when the number of printed sheets was 5,000, and that toner was adhering to the cleaning blade 61 to an extent where the cleaning performance decreased, in the case where the shape factor SF of the toner was 110. This is because the toner takes on a more spherical shape the lower the value of the shape factor SF is; the rolling resistance of the toner decreases, and it becomes easier for the toner to roll. In other words, the experimental results confirmed that if the shape factor of the toner is approximately 120 or greater, toner adhering to the cleaning blade 61 can be expected to decrease.

(1-4) Method for Creating Toner Containing Crystalline Resin

Next, detailed descriptions shall be given regarding a method for creating toner containing crystalline resin as described in the present exemplary embodiment.

<Example of Resin Synthesis>
<Crystalline Resin>
Synthesis Example 1 <Synthesis of Resin C1>

248 parts by weight of tetradecanedioate, 118.2 parts by weight of 1,6-hexanediol, and 0.12 parts by weight of dibutyltin oxide were agitated for six hours at 180° C. in a nitrogen atmosphere. This was subsequently agitated for four more hours while reducing pressure, and a crystalline resin C1 having a weight average molecular weight Mw of 25,500 was obtained. The melting point was 75° C.

<Example of Production of Crystalline Resin Emulsified Liquid>

Crystalline resin C1 (50 parts by weight) was dissolved in 250 parts by weight of ethyl acetate, to which was added a liquid in which 2 parts by weight of an anionic surface-active agent Dowfax was dissolved in 200 parts by weight of ion-exchanged water. This was agitated at 8,000 rpm for ten minutes using an Ultra-Turrax, after which the ethyl acetate was distilled away, and crystalline resin latex (F1) having a volume-average particle size of 0.20 μm was obtained.

<Non-crystalline Resin>
Non-crystalline Polyester Synthesis
Synthesis Example 2 <Synthesis of Resin A1 (Low Molecular Weight Substance)>

97.1 parts by weight of dimethyl terephthalate, 58.3 parts by weight of isophthalic acid, 53.3 parts by weight of anhydrous dodecenyl succinic acid, 94.9 parts by weight of bisphenol-A ethylene oxide adduct, 241 parts by weight of bisphenol-A propylene oxide adduct, and 0.12 parts by weight of dibutyltin oxide were agitated for six hours at 180° C. in a nitrogen atmosphere. This was subsequently agitated for five more hours at 220° C. while reducing pressure. When the molecular weight reached approximately 30,000, 8 parts by weight of trimellitic anhydride was added and the mixture agitated for another two hours. A non-crystalline polyester (A1) having a weight average molecular weight Mw of 45,900 was obtained. Glass transition temperature was 63° C.

<Example 1 of Production of Non-Crystalline Resin (Low Molecular Weight Substance) Emulsified Liquid>

Non-crystalline resin A1 (50 parts by weight) was dissolved in 250 parts by weight of ethyl acetate, to which was added a liquid in which 2 parts by weight of an anionic surface-active agent Dowfax was dissolved in 200 parts by weight of ion-exchanged water. This was agitated at 8,000 rpm for ten minutes using an Ultra-Turrax, after which the ethyl acetate was distilled away, and non-crystalline resin latex (D1) having a volume-average particle size of 0.18 μm in diameter was obtained.

Synthesis Example 3 <Synthesis of Resin B1 (High Molecular Weight Substance)>

97.1 parts by weight of dimethyl terephthalate, 38.8 parts by weight of isophthalic acid, 79.9 parts by weight of dodecenyl succinic anhydride, 94.9 parts by weight of bisphenol-A ethylene oxide adduct, 241 parts by weight of bisphenol-A propylene oxide adduct, and 0.12 parts by weight of dibutyltin oxide were agitated for six hours at 180° C. in a nitrogen atmosphere. This was subsequently agitated for two more hours at 220° C. while reducing pressure. When the molecular weight reached approximately 12000, 9 parts by weight of trimellitic anhydride was added and the mixture agitated for another hour. A non-crystalline polyester (B1) having a weight average molecular weight Mw of 14500 was obtained. Glass transition temperature was 61° C.

<Example 1 of Production of Non-Crystalline Resin (High Molecular Weight Substance) Emulsified Liquid>

Non-crystalline resin (non-crystalline polyester) B1 (50 parts by weight) was dissolved in 250 parts by weight of ethyl acetate, to which was added a liquid in which 2 parts by weight of an anionic surface-active agent Dowfax was dissolved in 200 parts by weight of ion-exchanged water. This was agitated at 8,000 rpm for ten minutes using an Ultra-Turrax, after which the ethyl acetate was distilled away, and non-crystalline resin latex (E1) having a volume-average particle size of 0.17 μm in diameter was obtained.

<Other Subsidiary Material Adjustments>
<Pigment Dispersion Adjustment>

The following compounds were mixed and dissolved, dispersed by a homogenizer (Ultra-Turrax T50, manufactured by IKA) an ultrasonically irradiated, and a blue pigment dispersion having a volume-average particle size of 150 nm was obtained.

cyan pigment C.I. Pigment Blue 15:3 (copper phthalocyanine, produced by Dainippon Ink and Chemicals, Inc.): 50 parts by weight anionic surface-active agent neogen SC: 5 parts by weight ion-exchanged water: 200 parts by weight <Releasing Agent Dispersion Adjustment>

The following compounds were mixed, heated at 97° C., and then dispersed by a homogenizer (Ultra-Turrax T50, manufactured by IKA). Dispersion treatment was subsequently performed using a Gaulin homogenizer (manufactured by the Meiwa company), and a releasing agent dispersion having a volume-average particle size of 190 nm was obtained through microparticulation by performing the treatment 20 times under conditions of 105° C., 550 kg/cm$^2$.

wax (WEP-5, produced by the NOF Corporation): 50 parts by weight anionic surface-active agent neogen SC: 5 parts by weight ion-exchanged water: 200 parts by weight <Example of Toner Production>

PRODUCTION EXAMPLE 1

Production of Electrophotographic Toner (1)

The following compounds were mixed and dispersed in a round, stainless flask using a homogenizer (Ultra-Turrax T50, manufactured by IKA); the contents of the flask were subsequently heated to 45° C. while being agitated, and held at 45° C. for 30 minutes.

| | |
|---|---|
| non-crystalline resin latex (D1): | 195 parts by weight |
| non-crystalline resin latex (E1): | 195 parts by weight |
| crystalline resin latex (F1): | 52 parts by weight |
| ion-exchanged water: | 250 parts by weight |
| pigment dispersion: | 33.5 parts by weight |
| releasing agent dispersion: | 67.5 parts by weight |
| 10% aluminum sulfate aqueous solution: | 75 parts by weight |

After this, 105 parts by weight of additional non-crystalline resin latex (D1) and 105 parts by weight of (E1) were added, and the resultant agitated for approximately 30 minutes. Observing the obtained contents through an optical microscope confirmed that an agglomerate having a particle diameter of approximately 6.5 μm had been generated. The pH of this was adjusted to 7.5 using a sodium hydroxide aqueous solution, after which the temperature was increased to 90° C.; this was agitated for 2.5 hours, causing the aggregate to coalesce, after which it was cooled, filtered, sufficiently washed with ion-exchanged water, and dried, whereby electrophotographic toner (1) was obtained. When the particle diameter of this electrophotographic toner (1) was measured, the volume-average particle size was 6.4 μm in diameter. Using an FPIA, the shape factor SF was 135.

PRODUCTION EXAMPLE 2

Production of Electrophotographic Toner (2)

Toner was produced in a similar manner to that of production example 1, the different point being that the agitation time at 90° C. was 4 hours. When the particle diameter was measured, the volume-average particle size was 6.4 μm in diameter. The shape factor SF was 120.

<Method for Measuring Viscoelasticity>

An ARES measurement device, manufactured by Rheometric Scientific, was used for measurement of the dynamic viscoelasticity of the toner in the present exemplary embodiment. In the measurement of the dynamic viscoelasticity, the toner was formed into a normal pellet and set on a parallel plate 25 mm in diameter. After the normal force was set to 0, a sine wave oscillation having an oscillation frequency of 6.28 rad/s was applied to the pellet.

The measurement sample was set on the parallel plate with an interval of 2.0 mm, and 90° C. was the starting point. Temperature control was performed using temperature control in the measurement system. The measurement time interval was 30 seconds, and the temperature adjustment precision after measurement was commenced was no more than ±1.0° C. In addition, the amount of distortion was maintained in each measurement temperature during measurement, and adjusted so that an appropriate measurement value could be obtained. In the measurement of the dynamic viscoelasticity, the stress arising from the amount of distortion is in a linear relationship, and the stress divided by the distortion amount at an arbitrary temperature is a constant value. However, in the case of a resin such as the toner of the present exemplary embodiment, a greater stress arising due to the distortion amount is measured the lower the measurement temperature and the lower the distortion amount; the higher the measurement temperature, an appropriate stress is not measured unless a large distortion amount is applied. Because there are lower and upper limits for the stress that can be measured by the dynamic viscoelasticity measurement device, generally, in order to performed measurement with a high measurement sensitivity in all temperature ranges under conditions in which the measurement temperature changes, the distortion amount is decreased at low temperatures and increased at high temperatures. The dynamic viscoelasticity measurement was performed with the distortion amount settings being performed automatically.

<Method for Measuring Shape Factor SF>

The equation for calculating the shape factor SF is as indicated by the abovementioned equation (1). The shape factor SF is digitized mainly by analyzing a microscope image or a scanning electron microscope (SEM) image using an image analysis device, and can, for example, the calculated in the manner described hereinafter. An optical microscope image of toner dispersed upon a slide glass is loaded into a Luzex image processor, and the maximum lengths and projected areas of no less than 100 toner particles are found through the abovementioned equation. The shape factor SF is found by taking the average of those values. In other words, the shape factor SF in the present exemplary embodiment is calculated by analyzing an image observed through an optical microscope using a Luzex image processor.

<Method for Measuring Particle Size>

Measurement of the particle size of the toner was performed in the following manner. The measurement device used was a Coulter Multisizer II (manufactured by Beckman Coulter), and the electrolyte used was ISOTON-II (also manufactured by Beckman Coulter).

As a method for measurement, 1.0 mg of the measurement sample was added to 2 ml of a surface-active agent, preferably a 5% aqueous solution of, sodium alkylbenzene sulfonate, used as a dispersant. This was added to 100 ml of the electrolyte, and an electrolyte in which the sample was suspended was obtained thereby.

Dispersion treatment was performed for one minute on the electrolyte in which the sample was suspended, using an ultrasonic dispersion device. Using the stated Coulter Counter TA-II with a 50 μm aperture, the particle size distribution of particles from 1-30 μm was measured, and the volumetric average distribution and the average distribution of the number of particles was found. The number of particles measured was 50,000.

In the case where the measured particle was less than 2 μm, measurement was performed using a laser diffraction particle size analyzer (LA-700, manufactured by Horiba). As a method for measurement, the sample in a fluid dispersion state was adjusted so that the solid content became approximately 2 g. Ion-exchanged water was added to this, with the total amount being 40 ml. This was introduced into a cell until an appropriate concentration was reached. Measurement was performed after about two minutes had passed and the concentration within the cell had generally stabilized. The volume-average particle size obtained per channel was accumulated from smaller volume-average particle sizes up, and when 50% was accumulated, this was taken as the volume-average particle size.

<Method for Measuring Molecular Weight>

A specific molecular weight distribution was carried out under the following conditions. The GPC used was an HLC-8120GPC, SC-8020 (manufactured by the Tosoh Corporation); two columns, TSK GEL Super HM-H, 6.0 mm ID×15 cm, also manufactured by the Tosoh Corporation, were used; and THF (tetrahydrofuran) was used as eluant. The experiment was performed using an IR detector under the following conditions: sample concentration, 0.5%; flow rate, 0.6 ml/min.; sample injection amount, 10 μl; and measurement temperature, 40° C. In addition, the calibration curve was created from ten samples of TSK standard polystyrene, produced by the Tosoh corporation: A-500; F-1; F-10; F-80; F-380; A-2500; F-4; F-40; F-128; and F-700.

<Method for Measuring Melting Point of Crystalline Resin and Glass Transition Temperature>

The melting point of the crystalline resin and the glass transition temperature of the toner were found from the main peak measured by an ASTMD 3418-8.

Measurement of the main peak can be measured using a DSC-7, manufactured by the Perkin Elmer corporation. Temperature correction in the detection portion of this device utilizes the melting points of indium and zinc; heat quantity correction utilizes the heat of fusion of indium. Measurement of the sample was performed using an aluminum pan, with an empty pan set as a control, and the temperature increase rate was 10° C./min.

(1-5) Cleaning Performance Comparison

Hereinafter, descriptions shall be provided regarding the presence/absence of white patches occurring at the time of image formation per predetermined number of printed sheets in the case where the stated toner using crystalline resin is used in the image forming apparatus 1 according to the present exemplary embodiment as described above and in a conventional image forming apparatus (in other words, a configuration not having the plate spring 62). FIG. 13 is a diagram illustrating the shape factor SF of the toner and the state of the occurrence of white patches per number of printed sheets, obtained based on the results of experimentation by the inventors. In FIG. 13, no white patches not occurring is indicated by a circle; white patches occurring is indicated by an x; and temporary occurrence of white patches that soon disappear is indicated by a triangle.

As shown in FIG. 13, it was confirmed that white patches did not occur in either apparatus with 10,000 or less printed sheets. It was confirmed that white patches began temporarily occurring, and that toner was beginning to adhere to the cleaning blade 61, in the conventional image forming apparatus, when the number of printed sheets reaches 14,000. However, in the image forming apparatus 1 of the present exemplary embodiment, white patches did not occur, and toner was not adhering to the cleaning blade 61, which is a cause of a decrease in cleaning performance. When the number of printed pages reached 18,000, the intermittent occurrence of white patches was confirmed in the conventional image forming apparatus, and toner had adhered to the cleaning blade 61. However, in the image forming apparatus 1 of the present exemplary embodiment, white patches were not confirmed, and less toner was adhering to the cleaning blade 61, which is a cause of a decrease in cleaning performance.

(2) Variations

The following variations may be made on the exemplary embodiment described above.

In the exemplary embodiment described above, the support member is formed of SUS or the like so that the loss coefficient is less than or equal to about $10^{-2}$, and the cleaning member is formed of a material such as rubber or the like that has a loss coefficient greater than about $10^{-2}$. The plate spring 62 is provided so that the cleaning blade 61 undergoes more skew. Accordingly, the loss coefficient of the plate spring 62 being less than the loss coefficient of the cleaning blade 61 contributes to the vibration amplitude of the self-excited vibration of the cleaning blade 61 being greater. Therefore, the combination of these members is not limited to that described above in the exemplary embodiment.

Furthermore, in the exemplary embodiment described above, an image forming apparatus 1 configured with an image holding apparatus integral to the configuration was given as an example. However, the image forming apparatus 1 maybe configured with, for example, the photoreceptor cleaner 60 and the image holding apparatus being attachable/detachable optional devices. In other words, the same image forming process can be realized even by integrating the photoreceptor cleaner 60 into an image forming apparatus that includes the stated photoreceptor 10, charging roll 20, exposure unit 30, developing unit 40, transfer roller 50, control unit 70, fuser (not shown), and the like. Furthermore, the configuration may be one in which an image holding apparatus having the stated photoreceptor 10, developing unit 40, and photoreceptor cleaner 60 is integrated into an image forming apparatus that includes, the charging roll 20, exposure unit 30, transfer roller 50, control unit 70, fuser (not shown), and the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated.

What is claimed is:

1. A cleaning apparatus comprising:

a cleaning member that makes contact with a surface of an image holder and vibrates due to friction arising when the surface of the image holder moves, the image holder bearing an electrostatic latent image developed using a developer having toner containing a crystalline resin; and a cleaning member support unit that supports the cleaning member and increases the amplitude of the vibration of the cleaning member, wherein a spring constant of the cleaning member support unit in a thickness direction is less than or equal to about 5 grams per millimeter.

2. A cleaning apparatus comprising:

a cleaning member; and a support member that supports the cleaning member so that the cleaning member makes contact with a surface of an image holder, the image holder bearing an electrostatic latent image developed using a developer having toner containing a crystalline resin, the cleaning member and the support member being substantially tabular members extending in the lengthwise direction of the image holder, a thickness of the support member being less than a thickness of the cleaning member, and a loss coefficient of the support member being smaller than a loss coefficient of the cleaning member, the loss coefficient being defined as a relative size of a loss modulus to a size of an elastic modulus, wherein a spring constant of the support member in a thickness direction is less than or equal to about 5 grams per millimeter.

3. The cleaning apparatus according to claim 2, wherein the loss coefficient of the support member is less than or equal to about $10^{-2}$, and the loss coefficient of the cleaning member is greater than about $10^{-2}$.

4. The cleaning apparatus according to claim 2, wherein the cleaning member vibrates due to friction arising when the surface of the image holder moves.

5. An image holding apparatus comprising:

an image holder;

a developing unit that develops an electrostatic latent image formed on a surface of the image holder using a developer having toner containing a crystalline resin; and a cleaning unit having a cleaning member and a support member that supports the cleaning member so that the cleaning member makes contact with a surface of the image holder, the cleaning member and the support member being substantially tabular members extending in a lengthwise direction of the image holder, a thickness of the support member being less than a thickness of the cleaning member, and a loss coefficient of the support member being smaller than a loss coefficient of the cleaning member, the loss coefficient being defined as a relative size of a loss modulus to a size of an elastic modulus, wherein a spring constant of the support member in a thickness direction is less than or equal to about 5 grams per millimeter.

6. The image holding apparatus according to claim 5, wherein the toner has a shape factor greater than or equal to about 120, the shape factor being defined by a following equation:

$$\text{shape factor}=(\text{absolute maximum length of toner diameter})^2/(\text{projected area of toner})\times(\pi/4)\times 100.$$

7. The image holding apparatus according to claim 5, wherein the cleaning member vibrates due to friction arising when the surface of the image holder moves.

8. An image forming apparatus comprising:

an image holder that rotates;

a charging unit that charges a surface of the image holder;

a latent image forming unit that forms a latent image on the surface of the image holder that has been charged by the charging unit;

a developing unit that develops an electrostatic latent image formed on the surface of the image holder using a developer having toner containing a crystalline resin;

a transfer unit that transfers the image developed by the developing unit; and a cleaning unit that cleans the surface of the image holder, the cleaning unit having a cleaning member and a support member that supports the cleaning member so that the cleaning member makes contact with the surface of the image holder, the cleaning member and the support member being substantially tabular members extending in a lengthwise direction of the image holder, a thickness of the support member being less than a thickness of the cleaning member, and a loss coefficient of the support member being smaller than a loss coefficient of the cleaning member, the loss coefficient being defined as a relative size of a loss modulus to a size of an elastic modulus, wherein a spring constant of the support member in a thickness direction is less than or equal to about 5 grams per millimeter.

9. The image forming apparatus according to claim 8, further comprising a control unit that controls a rotational speed of the image holder during cleaning of the surface of the image holder by the cleaning unit to be slower than a rotational speed of the image holder during image formation performed through the charging, the latent image formation, the image developing, and the image transfer.

10. The image forming apparatus according to claim 8, wherein the cleaning member vibrates due to friction arising when the surface of the image holder moves.

* * * * *